United States Patent [19]

Gostling

[11] 4,147,321

[45] Apr. 3, 1979

[54] DROP-HEAD SUPPORT ASSEMBLY

[75] Inventor: Peter E. Gostling, Sutton Coldfield, England

[73] Assignee: C. Evans & Sons Limited, Ilford, Essex, England

[21] Appl. No.: 835,858

[22] Filed: Sep. 23, 1977

[30] Foreign Application Priority Data

Oct. 7, 1976 [GB] United Kingdom ..... 41724/76

[51] Int. Cl.[2] ..... E04G 17/00; E04G 25/00

[52] U.S. Cl. ..... 248/354 R; 52/632; 52/645; 248/357; 249/210

[58] Field of Search ..... 52/632, 645, 646; 248/351, 354 R, 354 C, 354 H, 354 L, 354 P, 354 S, 357, 507, 508; 249/18, 210; 269/138, 234

[56] References Cited

U.S. PATENT DOCUMENTS

| | | | |
|---|---|---|---|
| 1,795,059 | 3/1931 | Vance et al. | 248/304 |
| 3,239,188 | 3/1966 | Gostling | 249/18 X |
| 3,614,048 | 10/1971 | Young | 249/18 |
| 3,647,173 | 3/1972 | Pipala | 248/354 R X |
| 3,915,423 | 10/1975 | Tooley | 249/18 X |

FOREIGN PATENT DOCUMENTS

| | | | |
|---|---|---|---|
| 2448617 | 4/1975 | Fed. Rep. of Germany | 249/210 |
| 1133974 | 11/1956 | France | 248/354 R |
| 739057 | 10/1955 | United Kingdom | 52/632 |
| 779466 | 7/1957 | United Kingdom | 248/357 |
| 936665 | 9/1963 | United Kingdom | 52/632 |
| 1191578 | 5/1970 | United Kingdom | 249/18 |

*Primary Examiner*—Lawrence J. Staab

*Attorney, Agent, or Firm*—Diller, Ramik & Wight

[57] ABSTRACT

The invention is concerned with a drop-head support assembly for use with builders scaffolding and is directed to an assembly comprising an upright pillar, a shuttering support member slidably mounted on the pillar, and a wedge device pivotally attached to the pillar to be moved between a horizontal position where it supports the support member and a vertical position where it releases the support member. The upper end of the pillar may also be adapted to receive a detachable head plate device.

13 Claims, 8 Drawing Figures

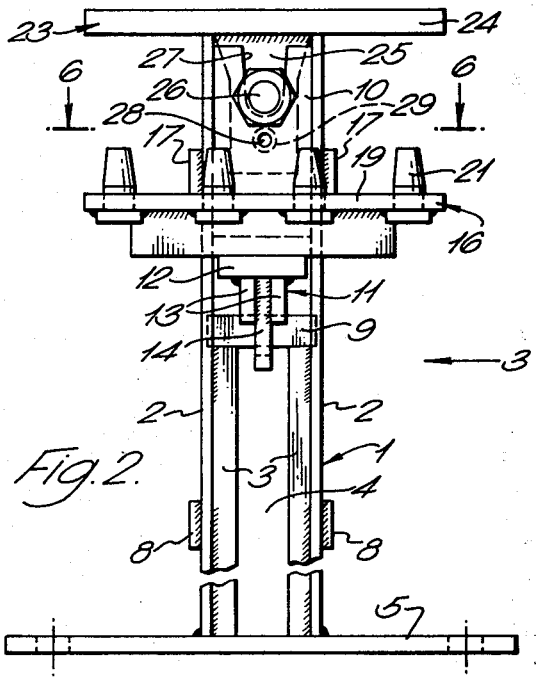
Fig. 2.
Fig. 6.
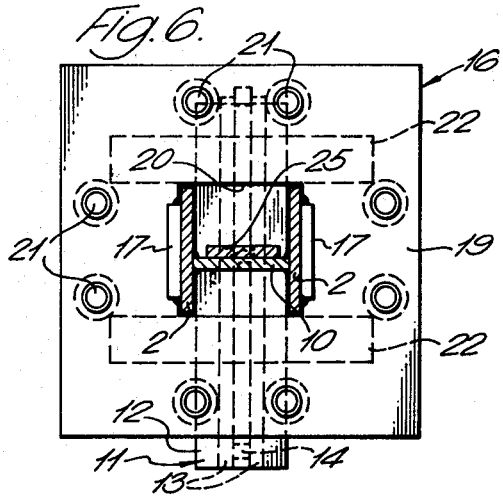

DROP-HEAD SUPPORT ASSEMBLY

This invention relates to an improved drop-head support assembly for use in the construction of concrete roofs, floors, ceilings or the like.

Drop-head assemblies of the kind to which the invention refers are used in combination with builders scaffolding or props to support the shuttering, usually in the form of decking panels with or without decking beams, used in the construction of concrete floors and other horizontal, or non-vertical, structures. Such assemblies are used to enable the shuttering elements to be removed progressively, prior to final hardening of the concrete, without leaving the concrete totally unsupported. Thus, the shuttering elements can be removed and re-used without taking away the props or scaffold elements which remain in position until the concrete is fully set.

Known drop-head assemblies for this purpose tend to be complicated and expensive to manufacture and it is among the objects of the present invention to provide a simplified assembly which is robust and relatively cheap to manufacture.

According to the present invention, there is provided a drop-head support assembly of the kind hereinbefore referred to, which comprises an upright pillar one end of which is provided, directly or indirectly, to be atached to a prop or the like and the other end of which is formed with, or is provided to receive, a head plate device a shuttering support member slidably mounted on the pillar, and a wedge device captively mounted on the pillar, wherein the wedge device includes an elongated tapered part which is pivotally attached to the pillar so as to be movable, in a vertical direction, between an operative position where it extends transverse to the axis of the pillar to hold the support member in its operative position, and an inoperative position where it is co-extensive with the axis of the pillar to permit movement of the support member into its inoperative position.

Preferably, the pillar is provided to detachably receive the head plate device so that, in practice, different forms of head plate may be used selectively.

Figure 1:
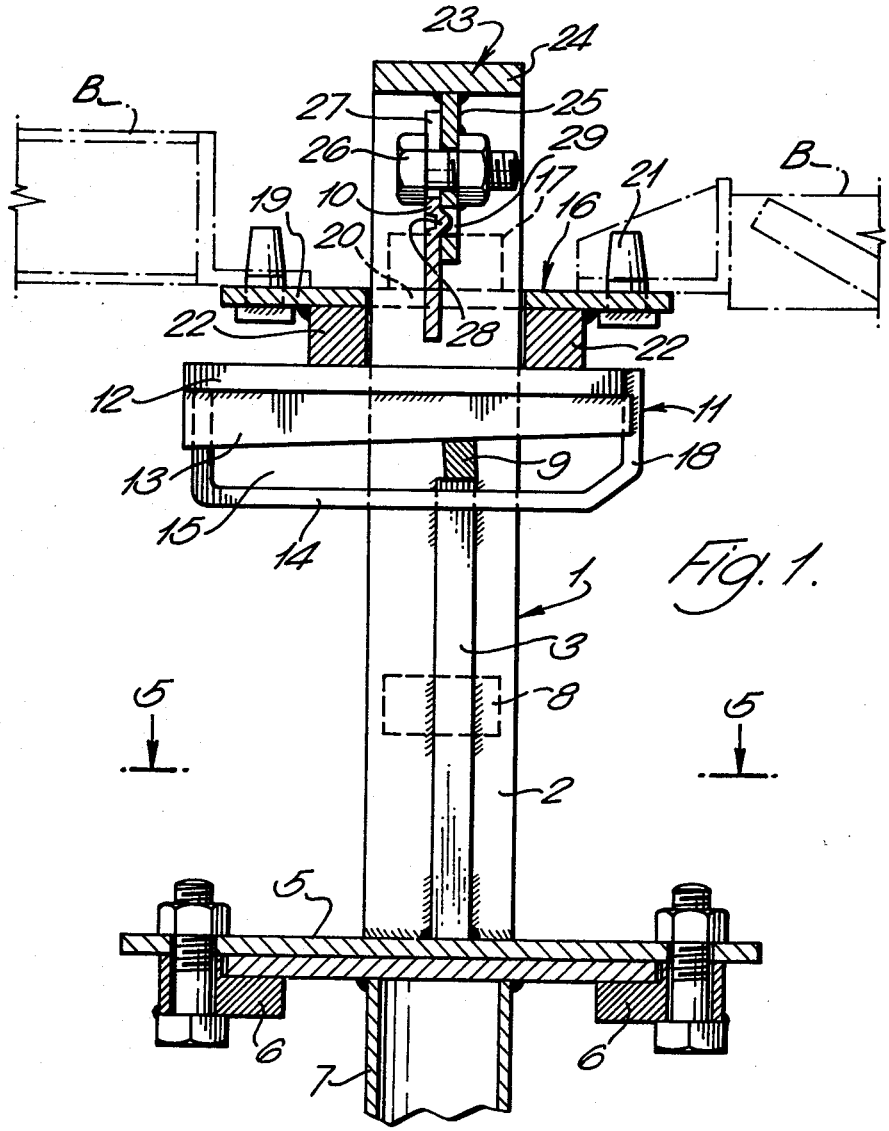
Figure 4:
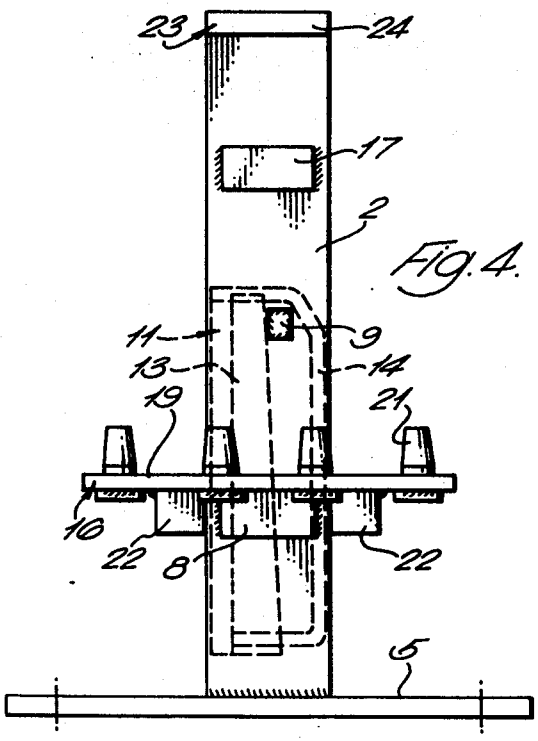
Figure 3:
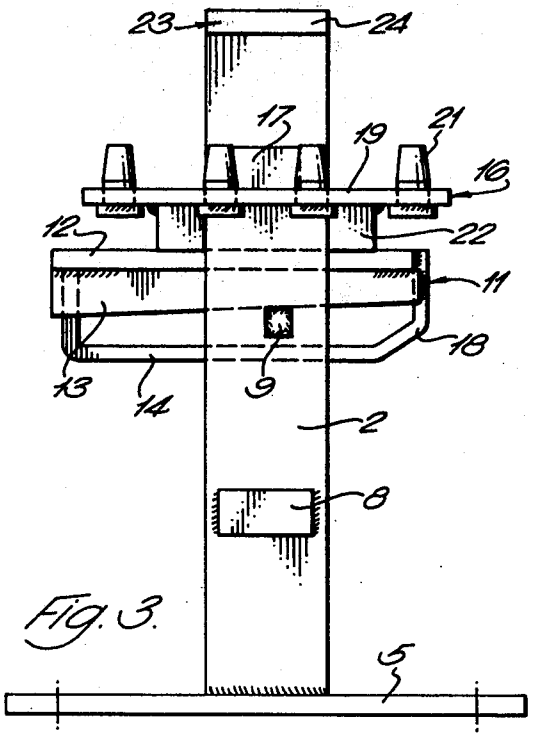
Figure 8:
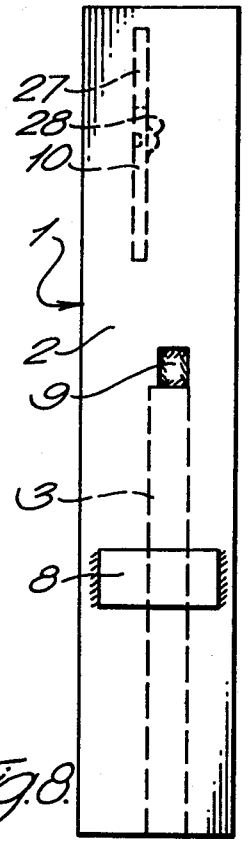
Figure 7:
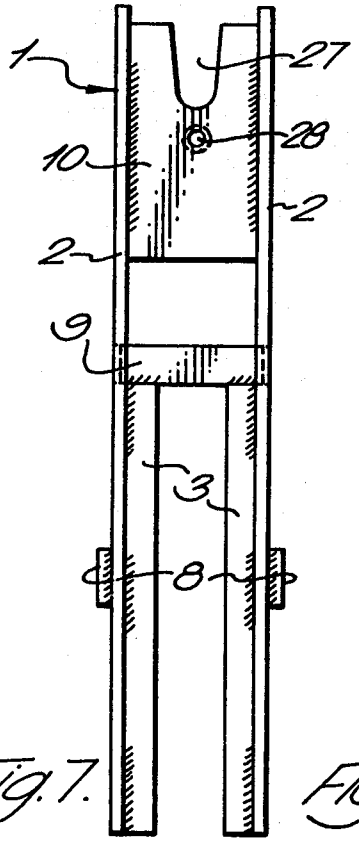
Figure 5:
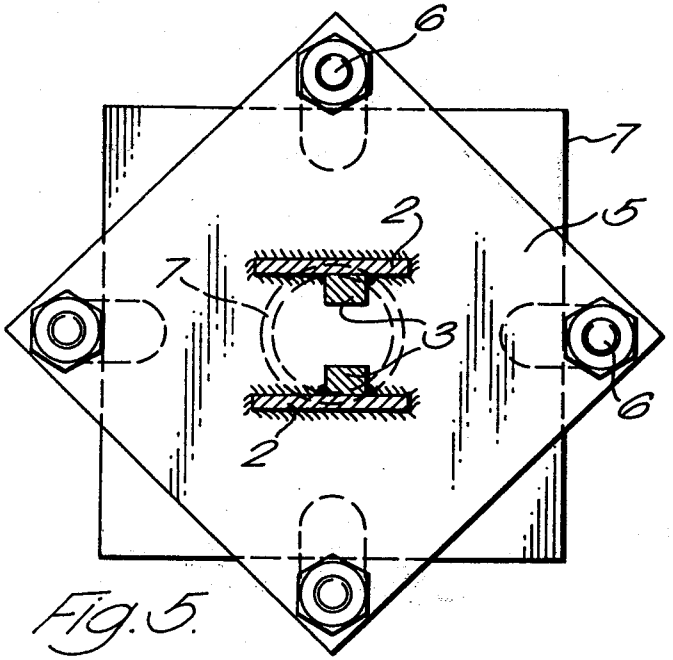

The invention is illustrated by way of example in the accompanying drawings in which, FIG. 1 is a section through a drop-head assembly according to the invention showing the support member in its raised or operative position, FIG. 2 is an elevation corresponding to FIG. 1, FIG. 3 is an elevation in the direction of the arrow "3" of FIG. 2, FIG. 4 is an elevation corresponding to FIG. 3 but showing the support member in its lowered or inoperative position, FIG. 5 is a section on the line 5—5 of FIG. 1, FIG. 6 is a section on the line 6—6 of FIG. 1, and FIGS. 7 and 8 are elevations of the pillar.

Referring to the drawings, there is shown a drop-head support assembly comprising an upright pillar 1 including a pair of spaced flanges 2 each having an inwardly directed web 3 of a length to present a space 4 therebetween.

The lower ends of the flanges 2 are fixed, as by welding, to a transverse base plate 5. The base plate 5 has associated therewith hook bolts 6 which serve to attach the assembly to the head of a prop indicated at 7. Stop plates 8, fixed to the flanges 2, are provided near the lower end of the pillar 1 for the purpose hereinafter described.

The webs 3 extend upwards from the lower ends of the flanges 2 at a distance which is approximately one half of the length of the flanges 2 and support a transversely disposed pin 9 of rectangular cross-section, the pin 9 also extending at its ends into openings formed in the flanges 2 in which openings it is welded to the flanges 2.

Spaced above the pin 9 is a web plate 10 which extends across the full distance between the flanges 2 and is fixed to the latter.

In the space between the pin 9 and the web plate 10 there is provided a wedge device 11. The device 11 comprises an elongated flange element 12, a pair of tapered elements 13 which are spaced apart and lie perpendicular to the flange element 12, and a wedge retainer bar 14 the ends of which are fixed in the space between the tapered elements 13. As can be seen from the drawing, the retainer bar 14 is formed to present an opening or slot 15 extending lengthwise of the elements 12 and 13 and the pin 9 extends through the opening or slot 15 so that the wedge device is held captive on the pillar 1. Also, it can be seen that the wedge device 11 is pivotable about the pin 9 so that it is movable, in a vertical direction, from its horizontal or operative position as shown in FIGS. 1 to 3 to its vertical or inoperative position as shown in FIG. 4 where it lies in the same vertical plane as that of the pillar 1.

In the operative position of the wedge device 11, the tapered faces of the elements 13 are in engagement with the uppermost face of the pin 9 and the flange element 12 supports an apertured support member 16 which is vertically slidable on the pillar 1. Thus, by hammering the wedge device to the right as shown in FIGS. 1 and 3, the member 16 is forced upwards into engagement with a pair of stop plates 17 fixed to the flanges 2 where it is temporarily retained.

In order to move the support member 16 into the lowered or inoperative position, the wedge device 11 is hammered in the opposite direction until it is free to pivot about the pin 9 and falls into the position shown in FIG. 4 whereupon the support member 16 slides downwardly over the pillar 1 into the position also shown in FIG. 4, where it is in engagement with, and supported by, the stop plates 8. In this respect, the retainer bar 14 is formed at one end with an angular portion 18 which engages the rectangular pin 9 to retain the wedge device 11 in a vertical position within the confines of the pillar 1.

The support member 16, as can best be seen in FIG. 6, consists of a flat rectangular plate 19 having a central rectangular aperture 20 by which it can slide over the pillar 1. The plate 19 has, adjacent each edge thereof, a pair of upstanding pegs 21 by which, in use, the ends of decking or other beams indicated at B are attached to the support member. The underside of the plate 19 has fixed thereto a pair of reinforcing or packing elements 22 which are engaged by the flange 12 of the wedge device 11.

At its upper end the pillar 1 is provided with a detachable head plate device 23 having a transverse plate 24 to which is fixed a central downwardly depending flange 25 having a transverse hole to receive a nut and bolt 26. When the head plate device is in position, the bolt is arranged to be received in a slot 27 formed in the upper edge of the web plate 10. The head plate is held firmly in position by tightening the bolt to effect locking engagement between the flange 25 and the web plate 10. To avoid having loose nuts and bolts which can be mislaid, the nut is preferably welded to the flange 25 and the end of the bolt is burned over so that it cannot be removed from the nut.

As can be seen from the drawing the flange 25 of the head plate device is positioned centrally relative to the pillar 1, whereas the web plate 10 is offset relative to the pillar 1. This arrangement ensures that the head plate device 23 which must be positioned centrally on the pillar 1, cannot be wrongly positioned. Furthermore, since the head plate device is detachable it provides the advantage that it can be replaced by head plates of different forms. However, it will be appreciated that, if desired, the head plate may be permanently fixed to the upper end of the pillar 1.

In use, a drop-head support assembly as hereinbefore described is attached to a prop 7 and the prop is adjusted to the required height. A decking beam B is then attached, as hereinbefore described, by one of its ends to the support member 16, the support member being held in its uppermost or operative position by the wedge device 11 as shown in FIGS. 1 to 3. The other end of the decking beam B is then attached to a second support member 16 and so on to build a framework on which shuttering panels or other shuttering means (not shown) are supported. In this position, the uppermost surfaces of the shuttering elements are level with the upper surface of the head plate devices 23 thereby providing a continuous flat surface.

In order to strike or dismantle the structure, the wedge devices 11 are hammered to the left as shown in FIGS. 1 to 3 and are caused to pivot downwardly into the inoperative position shown in FIG. 4. This results in the support members 16, and thus also the decking beams and shuttering elements, sliding downwardly relative to the pillars 1 into the position shown in FIG. 4. This provides sufficient space to remove the decking beams and the shuttering elements for re-use. In this respect, it will be seen that the aforementioned operation does not in any way affect the position of the head plate devices 23 which remain in position to support the concrete structure. Thus, it will be appreciated that the shuttering can be removed after initial setting of the concrete leaving the prop in position with the head plate devices to support the concrete until final setting thereof.

In practice, when handling the assembly, there may be a tendency, if the bolt 26 is not fully tightened, for the device 23 to fall out of the slot 27. To prevent this, the web plate 10 is formed with a dimple or projection 28 which extends into a hole 29 formed in the flange 25. Alternatively, the projection 28 can be provided on the flange 25 and the hole 29 formed in the web plate 10.

We claim:

1. A drop-head support assembly comprising an upright pillar having upper and lower end portions, means for forming a space between said end portions along a length of said pillar, said upper end portion being adapted to receive a detachable head plate device, said lower end portion being adapted for attachment to a scaffold or the like, a shuttering support member between said upper and lower end portions, means mounting said support member for sliding movement along said pillar between a raised operative position and a lowered inoperative position, wedge means captively mounted on said pillar for locking said support member in its raised operative position, said wedge means including a wedge device having an elongated tapered part, a slot extending lengthwise of said tapered portion, a pin passed through said slot transversely of said space and fixed to said pillar whereby said wedge device is pivotally attached to said pillar and is angularly movable relative thereto in a vertical direction between an operative position extending transverse to the longitudinal axis of said pillar to lock said support member in its raised operative position and an inoperative position at which said wedge device is co-extensive with the longitudinal axis of said pillar, and said space being of a size to accommodate said wedge device in its inoperative position to permit movement therepast of said support member from the latter's operative position to its inoperative position.

2. An assembly as claimed in claim 1, wherein said tapered part of said wedge device comprises an elongated flange element and a pair of spaced apart tapered elements lying perpendicular to said flange element, said slot being provided by a retainer bar a part of which is spaced from said tapered elements.

3. An assembly as claimed in claim 1, wherein said shuttering support member comprises a plate member having a central aperture to receive said pillar, and means for detachably receiving the ends of decking beams.

4. An assembly as claimed in claim 3, wherein said means for receiving said ends of said decking beams comprise upstanding pegs.

5. An assembly as claimed in claim 1, wheren stop means are provided on said pillar to limit the extent of vertical movement of said support member.

6. An assembly as claimed in claim 1, wherein said pillar, at its upper end portion, is formed with a vertically disposed web plate adapted to co-act with a detachable head plate device.

7. An assembly as claimed in claim 6, wherein said head plate device comprises a transverse element having a centrally disposed depending flange, a threaded bolt extending through a hole in said depending flange, and a nut co-acting with said bolt.

8. An assembly as claimed in claim 7, wherein said web plate is off centre relative to said pillar and is formed with a slot to receive, when said head plate device is in position, said bolt so that, no tightening said nut, said head plate device is fixed to said web plate.

9. An assembly as claimed in claim 8, wherein said nut is fixed to said depending flange of said head plate device.

10. An assembly as claimed in claim 6, wherein said web plate is formed with a projection to co-act with a hole formed in said depending flange of said head plate device.

11. An assembly as claimed in claim 6, wherein said depending flange of said head plate device is provided with a projection to co-act with a hole formed in said web plate.

12. The assembly as defined in claim 1 wherein said pin is of rectangular cross-section.

13. The assembly as defined in claim 1 wherein said support member is disposed in external surrounding relationship to said pillar, said support member includes an aperture through which said pillar member passes, and the size of said aperture admits the passage therethrough of said wedge device when the latter is in its inoperative position.

* * * * *